US011062660B1

(12) United States Patent
Sohn et al.

(10) Patent No.: US 11,062,660 B1
(45) Date of Patent: Jul. 13, 2021

(54) DISPLAY DEVICE AND METHOD OF COMPENSATING FOR DEGRADATION OF THE DISPLAY DEVICE

(71) Applicant: Samsung Display Co., Ltd., Yongin-Si (KR)

(72) Inventors: Young Soo Sohn, Yongin-si (KR); Jong Man Kim, Yongin-si (KR); Bong Gyun Kang, Yongin-si (KR); Jae Woo Ryu, Yongin-si (KR); Sung Mo Yang, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/942,224

(22) Filed: Jul. 29, 2020

(30) Foreign Application Priority Data

Jan. 14, 2020 (KR) ..... 10-2020-0004920

(51) Int. Cl.
*G09G 3/3291* (2016.01)

(52) U.S. Cl.
CPC ..... *G09G 3/3291* (2013.01); *G09G 2310/027* (2013.01); *G09G 2320/045* (2013.01)

(58) Field of Classification Search
CPC ... G09G 2320/0233; G09G 2320/0295; G09G 2320/0285; G09G 2320/043; G09G 2320/045; G09G 2320/0242; G09G 2320/0271; G09G 2320/029; G09G 2320/046; G09G 2320/0686; G09G 2330/10; G09G 2330/12; G09G 3/3208; G09G 3/3233; G09G 2300/0452; G09G 2300/0819; G09G 2300/0842
See application file for complete search history.

(56) References Cited

U.S. PATENT DOCUMENTS 6,618,115 B1 * 9/2003 Hiroki ..... G09G 3/002 324/760.01
10,360,828 B2 7/2019 Pyo et al.
2011/0074834 A1 3/2011 Chen et al.
2011/0242143 A1 * 10/2011 Yamashita ..... G09G 3/3233 345/690

(Continued)

FOREIGN PATENT DOCUMENTS

KR 10-2015-0034948 A 4/2015
KR 10-2017-0087093 A 7/2017

*Primary Examiner* — Dong Hui Liang
(74) *Attorney, Agent, or Firm* — Innovation Counsel LLP

(57) ABSTRACT

A display device includes a display panel, a first memory, and a degradation compensator. The first memory device stores stress data including degradation values representing a degradation degree of each of the blocks in the display panel. The degradation compensator loads the stress data from the first memory device, updates the stress data based on current input data and a maximum degradation value, updates the maximum degradation value based on degradation values included in the updated stress data, and generate compensated data by compensating for the current input data based on the updated stress data. The degradation compensator determines whether a first degradation value included in the stress data is normal by comparing the first degradation value with the maximum degradation value, and updates the first degradation value based on at least one adjacent degradation value adjacent to the first degradation value, when the first degradation value is abnormal.

25 Claims, 9 Drawing Sheets

(56) References Cited

U.S. PATENT DOCUMENTS

| | | | | |
|---|---|---|---|---|
| 2013/0147858 | A1* | 6/2013 | Omoto | G09G 3/3233 345/690 |
| 2015/0042697 | A1* | 2/2015 | Park | G09G 3/2092 345/690 |
| 2016/0140895 | A1 | 5/2016 | Park et al. | |
| 2017/0132979 | A1 | 5/2017 | Oh et al. | |
| 2017/0345377 | A1* | 11/2017 | Oh | G09G 3/3291 |
| 2018/0020525 | A1 | 1/2018 | Moon et al. | |

* cited by examiner

DISPLAY DEVICE AND METHOD OF COMPENSATING FOR DEGRADATION OF THE DISPLAY DEVICE

CROSS-REFERENCE TO RELATED APPLICATION

The present application claims priority under 35 U.S.C. § 119(a) to Korean patent application No. 10-2020-0004920 filed on Jan. 14, 2020, in the Korean Intellectual Property Office, the entire disclosure of which is incorporated herein by reference.

BACKGROUND

1. Technical Field

The present disclosure generally relates to a display device and a method of compensating for a degradation of the display device. More particularly, the present disclosure relates to a display device capable of preventing erroneous degradation compensation and a method of compensating for a degradation of the display device.

2. Related Art

A display device displays an image by using pixels each including a light emitting device. When the light emitting device is implemented as an organic light emitting diode, the light emitting device is degraded as it is used. With respect to the same grayscale value, a degraded light emitting device may emit light with a luminance lower than that of a light emitting device which is not degraded.

A conventional display device may calculate an age (or degradation amount) of a pixel by calculating a total amount of luminance of light emitted from the pixel, or the like, and compensate for a grayscale value based on the calculated age. The pixel (or light emitting device) may emit light with a desired luminance based on the compensated grayscale value.

As the resolution of a display device increases, age data (i.e., data including an age calculated for each pixel) may increase. Therefore, the display device may store age data by using a Dynamic Random Access Memory (DRAM), and partially and/or sequentially load and update the age data.

When an error occurs in a portion of the age data in a DRAM interface process, an error may also occur in an operation of compensating for a degradation (or grayscale value) of a pixel based on the age data (and the whole degradation compensating operation).

SUMMARY

Embodiments provide a display device capable of preventing erroneous degradation compensation and a method of compensating for a degradation of the display device.

In accordance with an aspect of the present disclosure, there is provided a display device including a display panel including a plurality of blocks each including at least one pixel; a first memory device configured to a store stress data including degradation values representing a degradation degree of each of the blocks; a degradation compensator configured to load the stress data from the first memory device, update the stress data based on current input data and a maximum degradation value, update the maximum degradation value based on degradation values included in the updated stress data, and generate compensated data by compensating for the current input data based on the updated stress data; and a data driver configured to generate data voltages based on the compensated data, and supply the data voltages to the display panel, wherein the degradation compensator determines whether a first degradation value included in the stress data is normal by comparing the first degradation value with the maximum degradation value, and updates the first degradation value based on at least one adjacent degradation value adjacent to the first degradation value, when the first degradation value is abnormal.

The degradation compensator may include a second memory circuit configured to store the stress data; and an error detection circuit configured to determine whether the first degradation value is normal, and update the first degradation value.

The second memory circuit may include a first buffer configured to store one line data among the stress data; a second buffer configured to repeatedly load and store the first degradation value from the first memory device, when the first degradation value is abnormal; and a third buffer configured to store the at least one adjacent degradation value.

The error detection circuit may include a determining circuit configured to determine that the first degradation value is abnormal, when the first degradation value is greater than the maximum degradation value; and an updating circuit configured to update the first degradation value based on the at least one adjacent degradation value and the maximum degradation value, when the first degradation value is abnormal.

When the first degradation value is greater than the maximum degradation value, the determining circuit may determine whether the first degradation value is abnormal, by repeatedly comparing degradation values stored in the second buffer with the maximum degradation value.

The updating circuit may calculate an average value by averaging the at least one adjacent degradation value stored in the third buffer, and update the first degradation value by weight-calculating the average value and the maximum degradation value.

A number of the at least one adjacent degradation value may vary depending on position information of the first degradation value stored in the stress data.

The degradation compensator may further include a scaling circuit configured to generate scaled data by scaling grayscale values included in the current input data based on the maximum degradation value; an age calculation circuit configured to update the stress data by accumulating the scaled data stored in the stress data; and a compensation circuit configured to generate the compensated data by compensating for the scaled data based on the updated stress data.

The degradation compensator may sequentially determine whether the degradation values included in the stress data are normal during a frame period, and update the maximum degradation value based on the largest value among the degradation values included in the updated stress data, during a blank period. The data voltages may be applied to the display panel during the frame period. The blank period may not overlap with the frame period.

The degradation compensator may not update the maximum degradation value, when the largest value among the degradation values included in the updated stress data is greater than a sum of the maximum degradation value and a reference value.

The first memory device may include a first sub-memory configured to store the stress data as first stress data; and a second sub-memory configured to the stress data as second stress data. The degradation compensator may load the first and second stress data respectively from the first and second sub-memories, determine whether a first degradation value included in the first stress data and a second degradation value, which is included in the second stress data and corresponds to the first degradation value, are equal to each other, and determine that the first degradation value is normal, when the first and second degradation values are equal to each other.

When the first and second degradation values are different from each other, the degradation compensator may update the first degradation value based on the at least one adjacent degradation value.

The display device may further include a second memory device configured to store the stress data. The first memory device may be implemented as a volatile memory device, and the second memory device may be implemented as a nonvolatile memory device. When power is applied, the first memory device may subsequently load the stress data from the second memory device.

In accordance with another aspect of the present disclosure, there is provided a method of compensating for a degradation of a display device, the method comprising steps of recording stress data in a first memory device; reading a first degradation value included in the stress data from the first memory device; determining whether the first degradation value is normal by comparing the first degradation value with a maximum degradation value; updating the first degradation value based on at least one adjacent degradation value adjacent to the first degradation value, when the first degradation value is abnormal; updating the stress data based on current input data and the maximum degradation value, when the first degradation value is normal; and generating compensated data by compensating for the current input data based on the updated stress data, wherein the stress data includes degradation values representing a degradation degree of each of a plurality of blocks of a display panel, wherein each of the plurality of blocks includes at least one pixel.

The method may further comprise steps of generating data voltages based on the compensated data; and supplying the data voltages to the display panel.

The determining of whether the first degradation value is normal may be accomplished by determining whether the first degradation value is smaller than or equal to the maximum degradation value; and re-reading the first degradation value, when the first degradation value is greater than the maximum degradation value.

The re-reading the first degradation value may be accomplished by: repeating, N times (N is a positive integer), the reading the first degradation value and the determining of whether the first degradation is smaller than or equal to the maximum degradation value.

The updating of the first degradation value may be accomplished by calculating an average value by averaging the at least one adjacent degradation value; and updating the first degradation value by weight-calculating the average value and the maximum degradation value.

The first memory device may comprise a first sub-memory configured to store the stress data as first stress data and a second sub-memory configured to store the stress data as second stress data. The determining of whether the first degradation value is normal may further be accomplished by determining whether a first degradation value included in the first stress data and a second degradation value which is included in the second stress data and corresponds to the first degradation value, are equal to each other; and comparing the first degradation value with the maximum degradation value, when the first and second degradation values are equal to each other.

The method may further comprise a step of updating the maximum degradation value based on the largest value among the degradation values included in the updated stress data. The maximum degradation value may not be updated, when the largest value among the degradation values included in the updated stress data is greater than the sum of the maximum degradation value and a reference value.

In accordance with still another aspect of the present disclosure, there is provided a method of compensating for a degradation of a display device which includes a display panel including pixels, a memory device for storing stress data representing a degradation degree of the pixels, and a degradation compensator for compensating for image data for the pixels based on the stress data, the method comprises steps of transmitting a first degradation value included in the stress data from the memory device to the degradation compensator; comparing, by the degradation compensator, the first degradation value with a predetermined maximum degradation value; determining, by the degradation compensator, that the first degradation value is abnormal, when the first degradation value is greater than the maximum degradation value; transmitting at least one adjacent degradation value adjacent to the first degradation value from the memory device to the degradation compensator, when the first degradation value is abnormal; and updating, by the degradation compensator, the first degradation value based on the at least one adjacent degradation value.

The determining of that the first degradation value is abnormal may be accomplished by re-transmitting the first degradation value from the memory device to the degradation compensator; comparing, by the degradation compensator, the re-transmitted first degradation value with the maximum degradation value; and determining, by the degradation compensator, that the first degradation value is abnormal, when the re-transmitted first degradation value is greater than the maximum degradation value.

The updating of the first degradation value may be accomplished by calculating, by the degradation compensator, an average degradation value by weight-averaging the at least one adjacent degradation value and the maximum degradation value; and updating, by the degradation compensator, the average degradation value as the first degradation value.

The method may further comprises steps of generating, by degradation compensator, a second degradation value by updating the updated first degradation value based on a grayscale value included in the image data; transmitting the second degradation value from the degradation compensator to the memory device; and updating, by the memory device, the stress data based on the second degradation value.

The method may further include steps of updating, by the degradation compensator, the maximum degradation value based on the second degradation value; and transmitting the updated maximum degradation value from the degradation compensator to the memory device.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
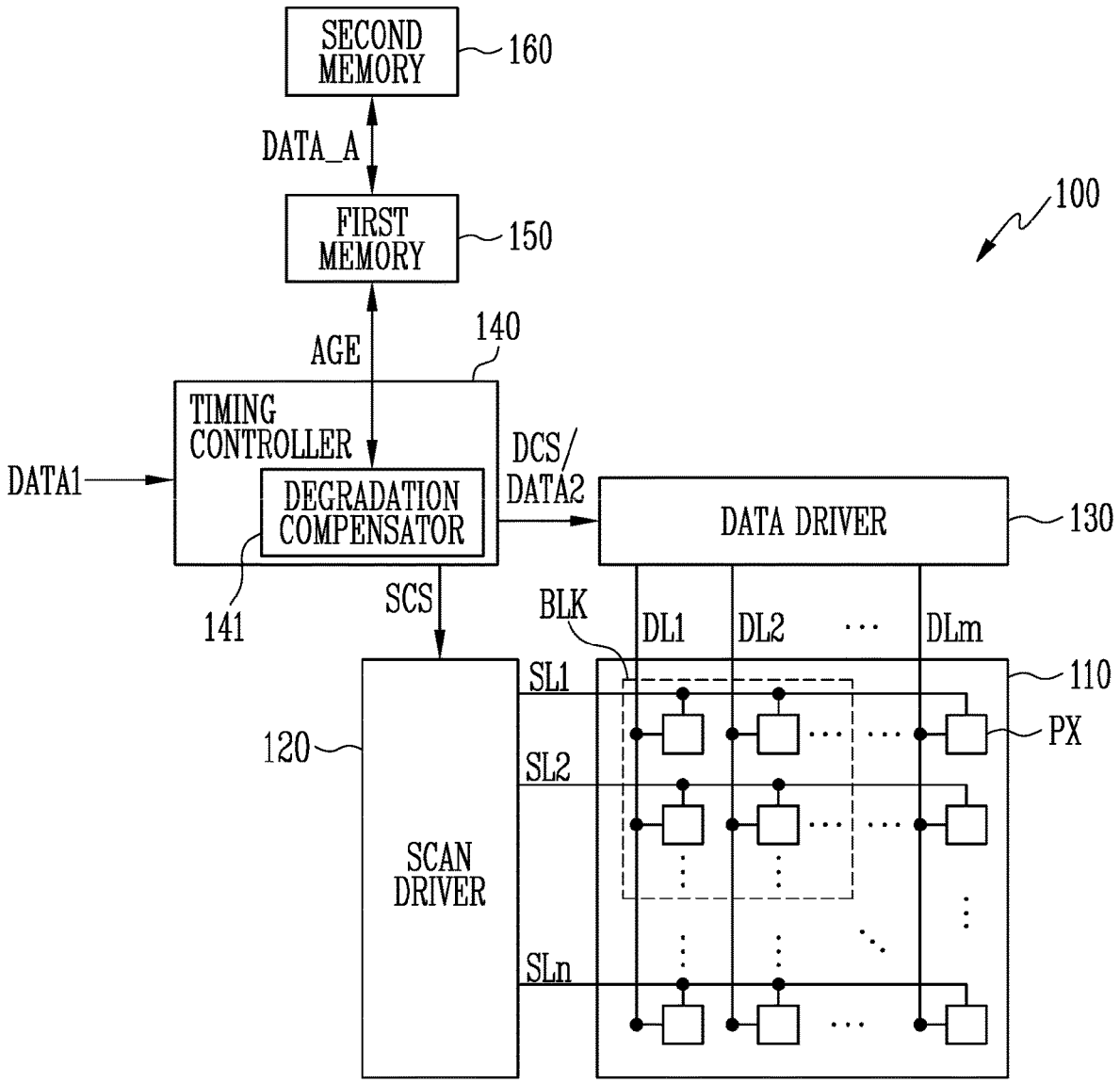
FIG. 1 is a block diagram illustrating a display device in accordance with embodiments of the present disclosure.

Hereinafter, example embodiments are described in detail with reference to the accompanying drawings so that those skilled in the art may easily practice the present disclosure. The present disclosure may be implemented in various different forms and is not limited to the example embodiments described in the present specification.

A part irrelevant to the description will be omitted to clearly describe the present disclosure, and the same or similar constituent elements will be designated by the same reference numerals throughout the specification. Therefore, the same reference numerals may be used in different drawings to identify the same or similar elements.

FIG. 1 is a block diagram illustrating a display device in accordance with embodiments of the present disclosure.

Referring to FIG. 1, the display device 100 may include a display 110 (or a display panel), a scan driver 120 (or a gate driver), a data driver 130 (or a source driver), and a timing controller 140. Also, the display device 100 may further include a first memory 150 (or a first memory device) and a second memory 160 (or a second memory device).

The display 110 may include scan lines SL1 to SLn (n is a positive integer), data lines from DL1 to DLm (m is a positive integer), and pixels PX. The pixels PX may be provided in areas (e.g., pixel areas) defined by the scan lines from SL1 to SLn and the data lines from DL1 to DLm.

The pixel PX may be coupled to one of the scan lines from SL1 to SLn and one of the data lines from DL1 to DLm. For example, a pixel PX provided in an area in which a first scan line SL1 and a first data line DL1 intersect each other may be coupled to the first scan line SL1 and the first data line DL1.

The pixel PX may include a light emitting device and at least one transistor. The at least one transistor may transfer, to the light emitting device, a current (or current amount) corresponding to a data signal through a data line, in response to a scan signal provided through a scan line. The light emitting device may emit light with a luminance corresponding to the current (i.e., a luminance corresponding to the data signal). The light emitting device may include an organic light emitting diode.

In an embodiment, the display 110 may include blocks BLK (or areas), and each of the blocks BLK may include at least one pixel PX. The blocks BLK may become a reference for calculating stress data DATA_A (age data or accumulated data) which will be described later. For example, the stress data DATA_A may include degradation values AGE, and one degradation value among the degradation values AGE may represent a degradation degree of a corresponding block among the blocks BLK, or an average degradation degree or average age of at least one pixel PX included in the corresponding block. For example, the degradation value may be a value obtained by accumulating a grayscale value of at least one pixel PX included in a corresponding block according to time, or a value in proportion to the accumulated value.

For example, each of the blocks BLK may include 8×8 pixels, and have a size of 8 [row]×8 [column] with respect to the pixel PX. That is, the display 110 may be divided into blocks BLK having a size of 8×8. For example, when the display 110 includes n×m pixels, the display 110 may be divided into n×m/64 blocks BLK.

The scan driver 120 may generate a scan signal based on a scan control signal SCS, and sequentially provide the scan signal to the scan lines from SL1 to SLn. The scan control signal SCS may include a start signal, clock signals, and the like, and be provided from the timing controller 140. For example, the scan driver 120 may include a shift register which sequentially generates and outputs a scan signal in the form of a pulse corresponding to the start signal in the form of a pulse by using the clock signals.

The data driver 130 may generate data signals based on image data DATA2 and a data control signal DCS, which are provided from the timing controller 140, and provide the data signals to the display 110 (or the pixels PX). The data control signal DCS is a signal for controlling an operation of the data driver 130, and may include a load signal (or data enable signal) indicating outputting of a valid data signal, and the like.

The first memory 150 may be coupled to the timing controller 140, the second memory 160 may be coupled to the first memory 150, and each of the first memory 150 and the second memory 160 may store stress data DATA_A.

For example, the first memory 150 may be implemented as a volatile memory device such as a Dynamic Random Access Memory (DRAM) or a Static Random Access Memory (SRAM), and the second memory 160 may be implemented as a nonvolatile memory device such as an Erasable Programmable Read-Only Memory (EPROM), an Electrically Erasable Programmable Read-Only Memory (EEPROM), a flash memory, a Phase Change Random Access Memory (PRAM), a Resistance Random Access Memory (RRAM), a Nano Floating Gate Memory (NFGM), a Polymer Random Access Memory (PoRAM), a Magnetic Random Access Memory (MRAM), a Ferroelectric Random Access Memory (FRAM). For example, the first memory 150 may be coupled to the timing controller 140 through a memory interface.

When the display device 100 is power on, the first memory 150 may load stress data DATA_A stored in the second memory 160. The first memory 150 may provide the timing controller 140 with degradation values AGE included in the stress data DATA_A in response to a request from the timing controller 140. The stress data DATA_A in the second memory 160 may be updated periodically and/or before the display device 100 is power off based on the stress data DATA_A in the first memory 150.

The timing controller 140 may receive input image data DATA1 (or current input data) and a control signal from the outside (e.g., a graphic processor), generate the scan control signal SCS and the data control signal DCS based on the control signal, and generate image data DATA2 by converting the input image data DATA1.

In some embodiments, the timing controller 140 may include a degradation compensator 141.

The degradation compensator 141 may load degradation values AGE included in stress data DATA_A from the first memory 150, update the degradation values AGE based on grayscale values and a maximum degradation value, which are included in input image data DATA1, and generate image data DATA2 (or compensated data) by compensating for the input image data DATA1 based on the updated degradation values. The stress data DATA_A stored in the first memory 150 may be updated in real time or periodically based on the updated degradation values.

Also, the degradation compensator 141 may determine whether each of the degradation values AGE provided from the first memory 150 is normal. For example, the degradation compensator 141 may determine whether a first degradation value included in the stress data DATA_A is normal by comparing the first degradation value with a maximum degradation value, and update the first degradation value based on at least one adjacent degradation value adjacent to the first degradation value, when the first degradation value is abnormal. When the first degradation value includes an error bit, the degradation compensator 141 may determine that the first degradation value is abnormal.

A detailed configuration of the degradation compensator 141 will be described with reference to FIG. 2.

Meanwhile, at least one of the scan driver 120, the data driver 130, and the timing controller 140 may be formed in the display 110, or be mounted in the form of an IC on a flexible circuit board to be coupled to the display 110. In addition, at least two of the scan driver 120, the data driver 130, and the timing controller 140 may be implemented as one IC.

Figure 2:
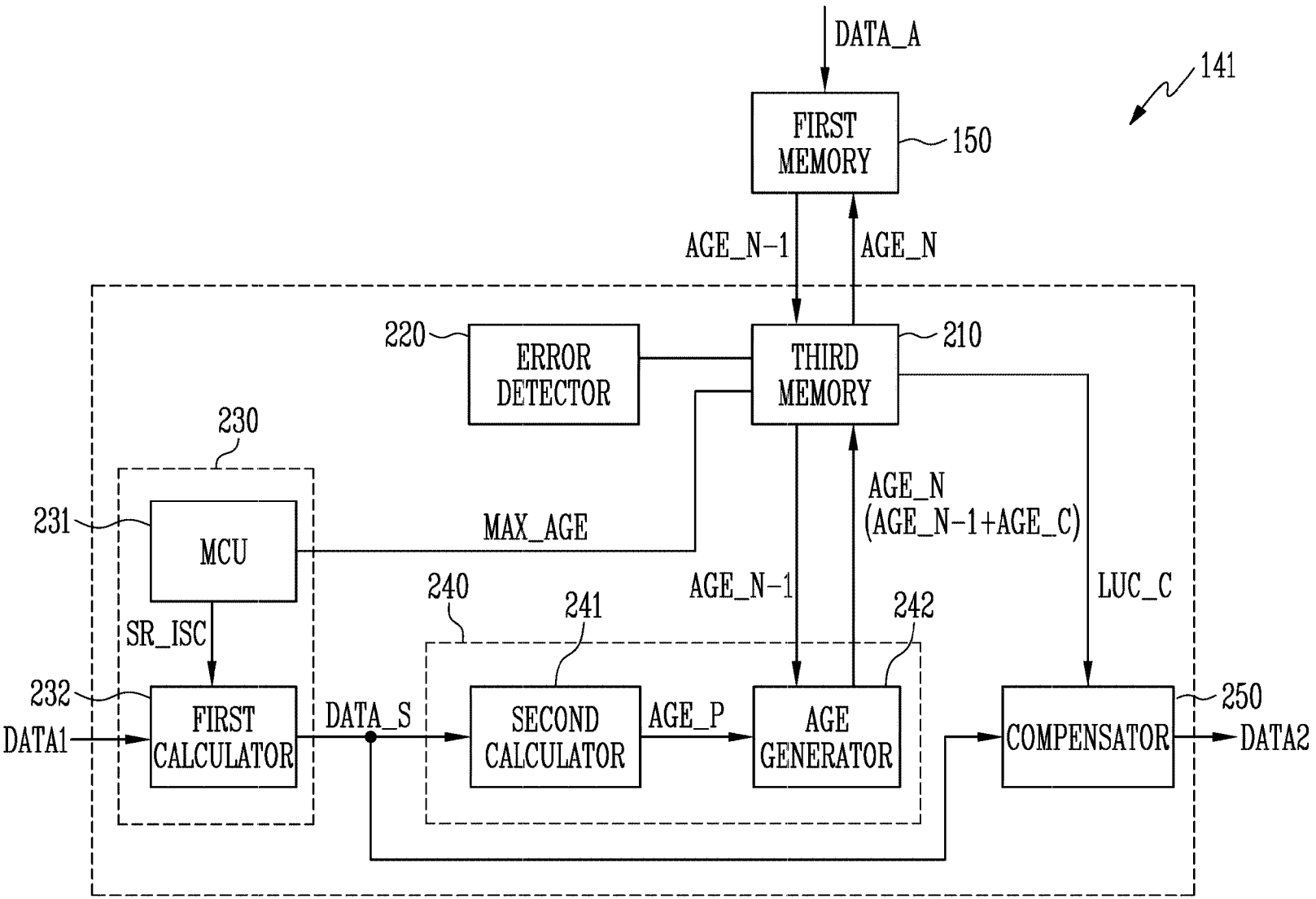
FIG. 2 is a block diagram illustrating an example of a degradation compensator included in the display device of FIG. 1.

FIG. 2 is a block diagram illustrating an example of the degradation compensator included in the display device of FIG. 1.

Referring to FIG. 2, the degradation compensator 141 may include a third memory 210 (or a third memory circuit), an error detector 220 (or an error detection circuit), a scaler 230 (or a scaling circuit), an age calculator 240 (or a age calculation circuit), and a compensator 250 (or a compensation circuit).

The third memory 210 may be implemented as a volatile memory device such as a Static Random Access Memory (SRAM). The third memory 210 may be coupled to the first memory 150 through a memory interface. The third memory 210 may sequentially load degradation values AGE (see i.e., FIG. 1) in stress data DATA_A (see i.e., FIG. 1) from the first memory 150. For example, the stress data DATA_A may include line data (i.e., degradation values divided in a unit of a line) respectively corresponding to the scan lines from SL1 to SLn (or pixel rows), and the third memory 210 may sequentially load and store the line data. The stress data DATA_A may include first degradation values AGE_N−1, and the first degradation values AGE_N−1 (N is a positive integer) may be degradation values at a previous time. Also, the stress data DATA_A may include a maximum degradation value MAX_AGE. The maximum degradation value MAX_AGE may be equal to or corresponding to the greatest value among the first degradation values AGE_N−1, and be calculated or determined by the age calculator 240.

The first degradation values AGE_N−1 stored in the third memory 210 may be updated as second degradation values AGE_N by an operation of the age calculator 240, and, the second degradation values AGE_N may be degradation values at a current time. For example, an interval between the current time and the previous time may be one frame, the second degradation values AGE_N may be degradation values for a current frame, and the first degradation values AGE_N−1 may be degradation values for a previous frame prior to the current frame. However, the interval between the current time and the previous time is not limited. The third memory 210 may provide the second degradation values AGE_N to the first memory 150, periodically and/or when an event occurs.

The error detector 220 may determine whether each of the first degradation values AGE_N−1 is normal based on the maximum degradation value MAX_AGE. For example, when a first degradation value (i.e., a specific degradation value) among the first degradation values AGE_N−1 is greater than the maximum degradation value MAX_AGE, the error detector 220 may determine that the first degradation value is abnormal.

Additionally, the error detector 220 may update an abnormal degradation value (i.e., a degradation value determined that it is abnormal) among the first degradation values AGE_N−1 based on at least one adjacent degradation value. The at least one adjacent degradation value is adjacent to the abnormal degradation value, and may be degradation values corresponding to blocks adjacent to a block (i.e., the block described with reference to FIG. 1) corresponding to the abnormal degradation value.

In a process of transmitting the first degradation value AGE_N−1 between the first memory 150 and the third memory 210, an error may occur in the first degradation values AGE_N−1. Although it will be described later, when a specific degradation value included in stress data DATA_A has a relatively large value due to a transmission error, the specific degradation value may have influence on the maximum degradation value MAX_AGE (e.g., the specific degradation value as an error is determined as the maximum degradation value MAX_AGE), and an error may occur in the entire stress data DATA_A (i.e., stress data generated and updated based on the maximum degradation value MAX_AGE). The stress data DATA_A is updated in a manner that accumulates a degradation amount at a current time in previous stress data, and therefore, erroneous degradation compensation may continuously occur. That is, an error may occur in the entire stress data DATA_A due to one degradation value error (e.g., one data bit error), and a continuous error (and erroneous degradation compensation) instead of a temporary error may occur.

The error detector 220 determines whether each of the first degradation values AGE_N−1 is normal based on the maximum degradation value MAX_AGE so that an abnormal degradation value can be prevented from having influence on the maximum degradation value MAX_AGE and the entire stress data DATA_A.

The scaler 230 may generate scaled data DATA_S by scaling grayscale values included in input image data DATA1 (or current input data) based on the maximum degradation value MAX_AGE.

In an embodiment, the scaler 230 may include a scaling ratio calculator 231 (or Micro Control Unit (MCU)) and a first calculator 232.

The scaling ratio calculator 231 may calculate a scaling ratio SR_ISC based on the maximum degradation value MAX_AGE. For example, a lookup table may include a scaling ratio SR_ISC according to the maximum degradation value MAX_AGE, and the scaling ratio calculator 231 may acquire the scaling ratio SR_ISC corresponding to the maximum degradation value MAX_AGE by using the lookup table. For example, the scaling ratio SR_ISC may have value smaller than or equal to 1. However, the present disclosure is not limited, and, for example, the scaling ratio SR_ISC may have a value greater than 1.

The first calculator 232 may generate scaled data DATA_S by scaling input image data DATA1 based on the scaling ratio SR_ISC. For example, the first calculator 232 may generate the scaled data DATA_S by multiplying each of grayscale values included in the input image data DATA1 by the scaling ratio SR_ISC. For example, when the scaling ratio SR_ISC has a value smaller than 1, the input image data DATA1 may be reduced. Therefore, a margin for degradation compensation (i.e., degradation compensation using a data compensation method) may be secured.

The age calculator 240 may update the first degradation values AGE_N−1 as second degradation values AGE_N by accumulating grayscale values included in the scaled data DATA_S respectively in the first degradation values AGE_N−1. That is, the scaled data DATA_S is accumulated in the stress data DATA_A including the first degradation values AGE_N−1 so that the stress data DATA_A can be updated. The first degradation values AGE_N−1 may be provided from the third memory 210. The age calculator 240 may generate second degradation values AGE_N (i.e., degradation values at a current time) by accumulating the grayscale values included in the scaled data DATA_S (or third degradation values AGE_C corresponding thereto) in the first degradation values AGE_N−1. The second degradation values AGE_N may be stored in the third memory 210.

In an embodiment, the age calculator 240 may include a second calculator 241 and an age generator 242.

The second calculator 241 may generate accumulated values AGE_P based on the scaled data DATA_S. For example, the second calculator 241 may generate accumulated values AGE_P in proportion to the grayscale values included in the scaled data DATA_S. For example, the second calculator 241 may calculate average grayscale values in a unit of the blocks BLK described with reference to FIG. 1, and calculate accumulated values AGE_P in proportion to the average grayscale values. For example, the second calculator 241 may calculate an average grayscale value for a corresponding block by averaging grayscale values corresponding to the corresponding block (i.e., the grayscale values included in the scaled data DATA_S), and calculate an accumulated value for the corresponding block based on the average grayscale value.

The age generator 242 may generate third degradation values AGE_C (or final accumulated values) by compensating for the accumulated values AGE_P based on a driving frequency (or regeneration factor) of the display device 100, a driving condition (e.g., an ambient temperature), and positions of corresponding blocks. For example, the age generator 242 may multiply the accumulated values AGE_P by a first factor corresponding to a driving frequency. For example, the age generator 242 may determine a second factor for a driving condition and a third factor for a position based on a predetermined lookup table (e.g., a lookup table including second factors predetermined for each temperature and third factors predetermined for each position), and multiply the accumulated values AGE_P by the second factor and the third factor.

Also, the age generator 242 may generate second degradation values AGE_N by accumulating (or adding) the third degradation values AGE_C in (or to) the first degradation values AGE_N−1 (i.e., degradation values at a previous time). The second degradation values AGE_N may be stored in the third memory 210, and the stress data DATA_A stored in the first memory 150 may be updated based on the second degradation values AGE_N transmitted from the third memory 210.

The age generator 242 may update the maximum degradation value MAX_AGE based on the second degradation values AGE_N. For example, the age generator 242 may set the greatest degradation value among the second degradation values AGE_N as the maximum degradation value MAX_AGE. That is, the stress data DATA_A and the maximum degradation value MAX_AGE may be periodically updated.

In an embodiment, the age generator 242 may determine whether a difference between a first maximum degradation value and a second maximum degradation value is greater than a reference value. When the difference is greater than the reference value, the age generator 242 may not update the maximum degradation value MAX_AGE. The first maximum degradation value may be a maximum degradation value calculated at a current time, and the second maximum degradation value may be a maximum degradation value calculated at a previous time (i.e., a maximum degradation value before it is updated). The reference value is a maximum accumulated value which the third degradation values AGE_C may have, and may represent a degradation amount with which a specific block can be maximally degraded during an update period of the maximum degradation value (e.g., during one frame). That is, when the difference between the first maximum degradation value and the second maximum degradation value is greater than the reference value, the age generator 242 may determine that an error occurs in the first maximum degradation value, and may not update the maximum degradation value MAX_AGE. In addition, since the maximum degradation value MAX_AGE is not updated, an abnormal degradation value (i.e., a degradation value contributing to the first maximum degradation value in which the error occurs) among the first degradation values AGE_N−1 may be subsequently corrected by the error detector 220.

The compensator 250 may generate image data DATA2 (i.e., compensated data) by compensating for the scaled data DATA_S based on the second degradation values AGE_N (i.e., the updated stress data DATA_A). For example, the compensator 250 may generate image data DATA2 by using a predetermined lookup table LUC_C. The lookup table LUC_C may include a compensation grayscale value (or compensated grayscale value) according to a degradation value, and the compensator 250 may determine a compensation grayscale value corresponding to a grayscale value included in the scaled data DATA_S.

As depicted in FIG. 2, the third memory 210 may be coupled to the first memory 150 through the memory interface, and transmit/receive degradation values included in stress data DATA_A. The error detector 220 may determine whether each of the degradation values included in the stress data DATA_A is normal by comparing each of the degradation values with the maximum degradation value MAX_AGE, and update (or reset) an abnormal degradation value based on at least one adjacent degradation value. Thus, an erroneous degradation compensation operation of the display device 100, which is caused by an abnormal degradation value, can be prevented.

Figure 3:
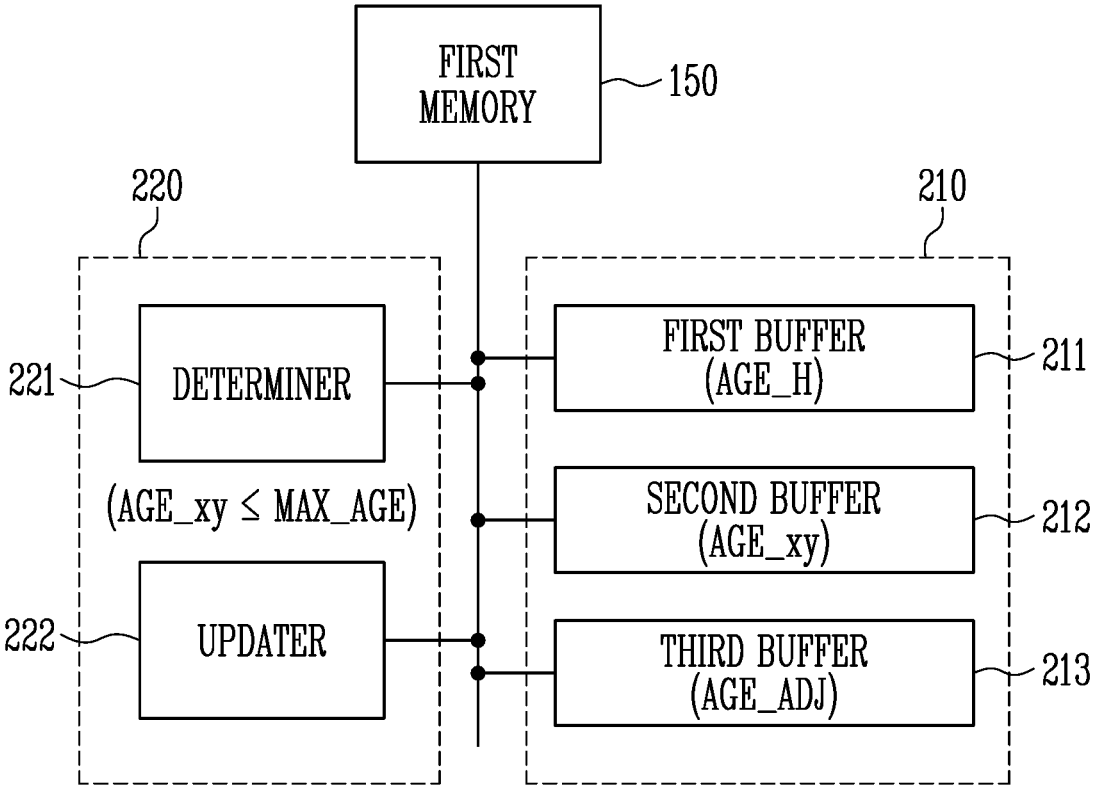
FIG. 3 is a block diagram illustrating an example of a third memory and an error detector, which are included in the degradation compensator of FIG. 2.

FIG. 3 is a block diagram illustrating an example of the third memory and the error detector, which are included in the degradation compensator of FIG. 2.

Referring to FIGS. 2 and 3, the third memory 210 may include a first buffer 211 (or a first memory device), a second buffer 212 (or a second memory device), and a third buffer 213 (or a third memory device).

The first buffer 211 may store one line data AGE_H (e.g., degradation values corresponding to one horizontal line among the degradation values included in the stress data) transmitted from the first memory 150 among the stress data. Also, when a first degradation value (or an xyth degradation value AGE_xy) (each of x and y is a positive integer) included in the line data AGE_H is abnormal, the first buffer 211 may repeatedly load and store the first degradation value from the first memory 150 until the first degradation value is found to be normal.

Similarly, the second buffer 212 may store another line data transmitted from the first memory 150 among the stress data. Also, when a degradation value included in the another line data is abnormal, the second buffer 212 may repeatedly load and store the corresponding degradation value (e.g., the xyth degradation value AGE_xy) from the first memory 150.

Two line data may be loaded from the first memory 150 to be respectively stored in the first buffer 211 and the second buffer 212, but the present disclosure is not limited. For example, the line data may be sequentially loaded from the first memory 150, and be alternately stored in the first buffer 211 and the second buffer 212.

The third buffer 213 may store at least one adjacent degradation value AGE_ADJ.

The error detector 220 may include a determiner 221 and an updater 222.

The determiner 221 may compare a first degradation value (e.g. an xyth degradation value AGE_xy) included in the line data AGE_H with a maximum degradation value MAX_AGE, and determine that the first degradation value is abnormal when the first degradation value is greater than the maximum degradation value MAX_AGE.

In an embodiment, when the first degradation value is greater than the maximum degradation value MAX_AGE, the first degradation value stored in the first memory 150 may be repeatedly re-loaded (or read) by a predetermined retry number to be stored in the second buffer 212, and the determiner 221 may determine whether the first degradation value is normal (or abnormal) by sequentially repeatedly comparing the re-loaded first degradation value (i.e., the degradation value stored in the second buffer 212) with the maximum degradation value MAX_AGE. For example, when the case where the re-loaded first degradation value is greater than the maximum degradation value MAX_AGE occurs three times or more, the determiner 221 may determine that the first degradation value is abnormal. Therefore, at least one adjacent degradation value AGE_ADJ may be read from the first memory 150, to be stored in the third buffer 213.

When the first degradation value is abnormal, the updater 222 may re-calculate or update the first degradation value based on the at least one adjacent degradation value AGE_ADJ and the maximum degradation value MAX_AGE.

In an embodiment, the updater 222 may update the first degradation value by weight-averaging the at least one adjacent degradation value AGE_ADJ stored in the third buffer 213 and the maximum degradation value MAX_AGE. For example, the updater 222 may calculate an average value by averaging the at least one adjacent degradation value stored in the third buffer 213, and update the first degradation value by weight-averaging the average value and the maximum degradation value MAX_AGE.

For example, the updater 222 may re-calculate a first degradation value based on the following Equation 1.

$$\text{AGE_xy} = \frac{\text{SUM}(\text{AGE}_{-(x-1)(y-1)}:\text{AGE}_{-(x+1)(y+1)})}{r} \times a + \text{AGE_MAX} \times b \qquad \text{Equation 1}$$

$$\text{AGE_xy} = \frac{\text{SUM}(\text{AGE_}(x-1)(y-1):\text{AGE_}(x+1)(y+1))}{r} \times a + \text{AGE_MAX} \times b.$$

AGE_xy is an xyth degradation value, AGE_(x−1)(y−1) to AGE_(x+1)(y+1) are adjacent degradation values adjacent to the xyth degradation value, as an (x−1)(y−1)th degradation value to an (x+1)(y+1)th degradation value, r is a number of referred degradation values among the adjacent degradation values (i.e., a reference number), and each of a and b is a weight constant. The sum of a and b may be smaller than or equal to 1.

An operation of the updater 222 using Equation 1 will be described with reference to FIG. 4.

Figure 4:
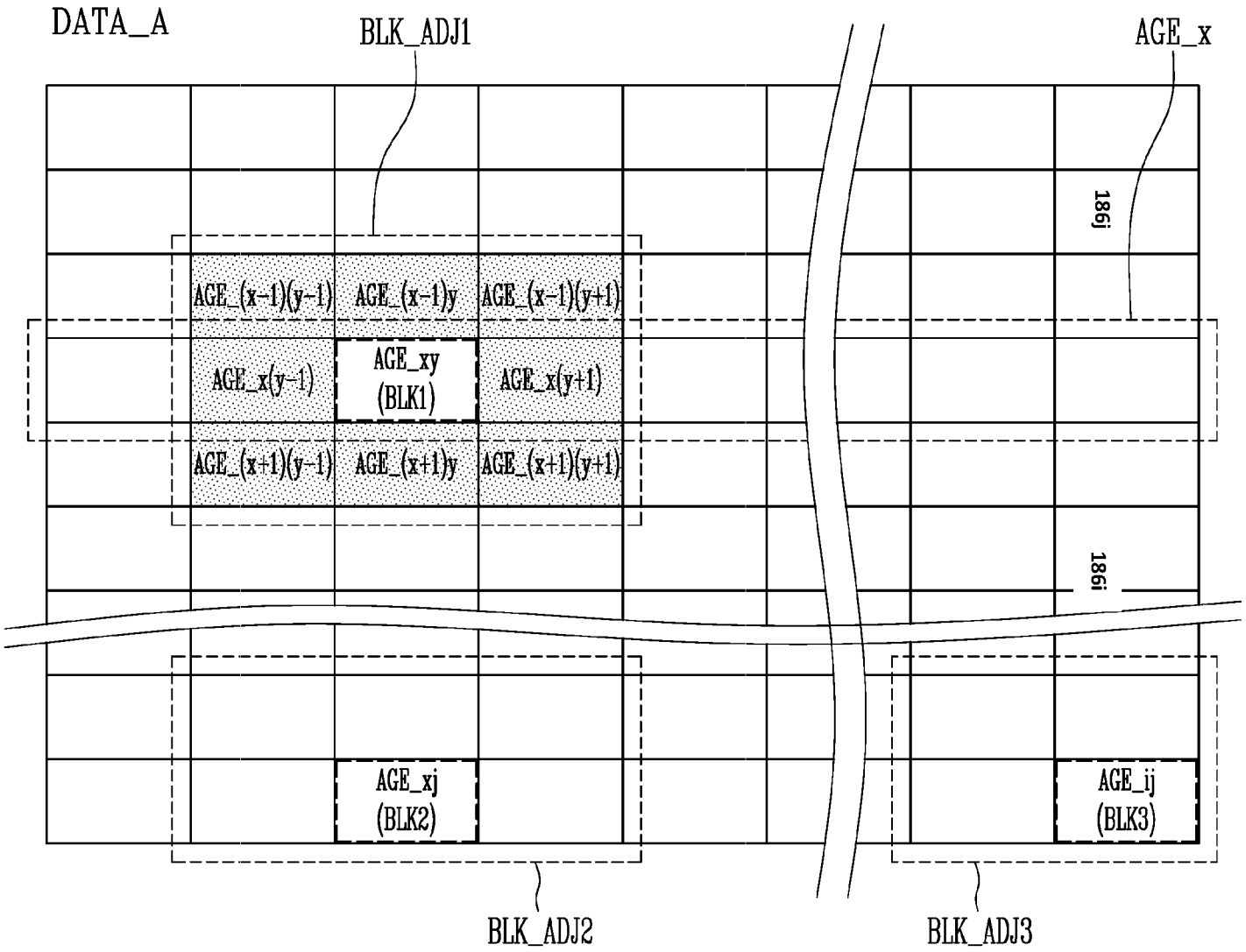
FIG. 4 is a diagram illustrating an example of stress data used in the degradation compensator of FIG. 2.

FIG. 4 is a diagram illustrating an example of the stress data used in the degradation compensator of FIG. 2.

Referring to FIGS. 2 and 4, the stress data DATA_A may include degradation values corresponding to the blocks BLK described with reference to FIG. 1.

One line data in a row direction among the stress data DATA_A may be sequentially loaded from the first memory 150, to be stored in the first buffer 211. For example, at a specific time, x line data AGE_x may be read to be stored in the first buffer 211.

When an xyth degradation value AGE_xy included in the x line data AGE_x is abnormal, adjacent degradation values AGE_(x−1)(y−1), AGE_x(y−1), AGE_(x+1)(y−1), AGE_(x−1)y, AGE_(x+1)y, AGE_(x−1)(y+1), AGE_x(y+1), and AGE_(x+1)(y+1) adjacent to the xyth degradation value AGE_xy may be stored in the third buffer 213. That is, degradation values of first adjacent blocks BLK_ADJ1 adjacent to a first block BLK1 corresponding to the xyth degradation value AGE_xy may be stored in the third buffer 213.

Pixels located adjacent to each other may have similar characteristics, and emit lights with roughly similar luminances. Therefore, the updater 222 may update the xyth degradation value AGE_xy by using the adjacent degradation values AGE_(x−1)(y−1), AGE_x(y−1), AGE_(x+1)(y−1), AGE_(x−1)y, AGE_(x+1)y, AGE_(x−1)(y+1), AGE_x(y+1), and AGE_(x+1)(y+1).

Alternatively, the xyth degradation value AGE_xy may be a value similar to the maximum degradation value MAX_AGE, and therefore, the updater 222 may set the xyth degradation value AGE_xy to be equal or similar to the maximum degradation value MAX_AGE. The weight constants a and b may be set by considering these cases, and the updater 222 may update the xyth degradation value AGE_xy based on the adjacent degradation values AGE_(x−1)(y−1), AGE_x(y−1), AGE_(x+1)(y−1), AGE_(x−1)y, AGE_(x+1)

y, AGE_(x−1)(y+1), AGE_x(y+1), and AGE_(x+1)(y+1) and the maximum degradation value MAX_AGE.

In an embodiment, a number of at least one adjacent degradation values may vary depending on position information of the first degradation value in the stress data DATA_A.

For example, a number of first adjacent degradation values corresponding to the xyth degradation value AGE_xy located at a central portion of the stress data DATA_A may be eight. For example, a number of second adjacent degradation values corresponding to an xjth degradation value AGE_xj located at one side of the stress data DATA_A may be five. That is, a number of second adjacent blocks BLK_ADJ2 adjacent to a second block BLK2 corresponding to the xjth degradation value AGE_xj (j is a positive integer) may be five, and the reference number r in Equation 1 may be five. For example, a number of third adjacent degradation values corresponding to an ijth degradation value AGE_ij (i is a positive integer) located at one corner of the stress data DATA_A, i.e., a number of third adjacent blocks BLK_ADJ3 adjacent to a third block BLK3 may be three, and the reference number r in Equation 1 may be 3.

Meanwhile, although a case where the number of adjacent degradation values adjacent to the xyth degradation value AGE_xy is illustrated in Equation 1 (and FIG. 4), this is merely illustrative, and the number of adjacent degradation values may be variously set.

In addition, although a case where the adjacent degradation values adjacent to the xyth degradation value AGE_xy include degradation values included in rows different from that of the xyth degradation value AGE_xy is illustrated in FIG. 4, this is merely illustrative, and the adjacent degradation values adjacent to the xyth degradation value AGE_xy may include only degradation values (e.g., AGE_x(y−1) and AGE_x(y+1)) included in the same row as the xyth degradation value AGE_xy.

That is, it is sufficient when the updater 222 updates a first degradation value based on adjacent degradation values adjacent to the first degradation value (and the maximum degradation value MAX_AGE), and a number and positions of the adjacent degradation values are not particularly limited.

Figure 5:
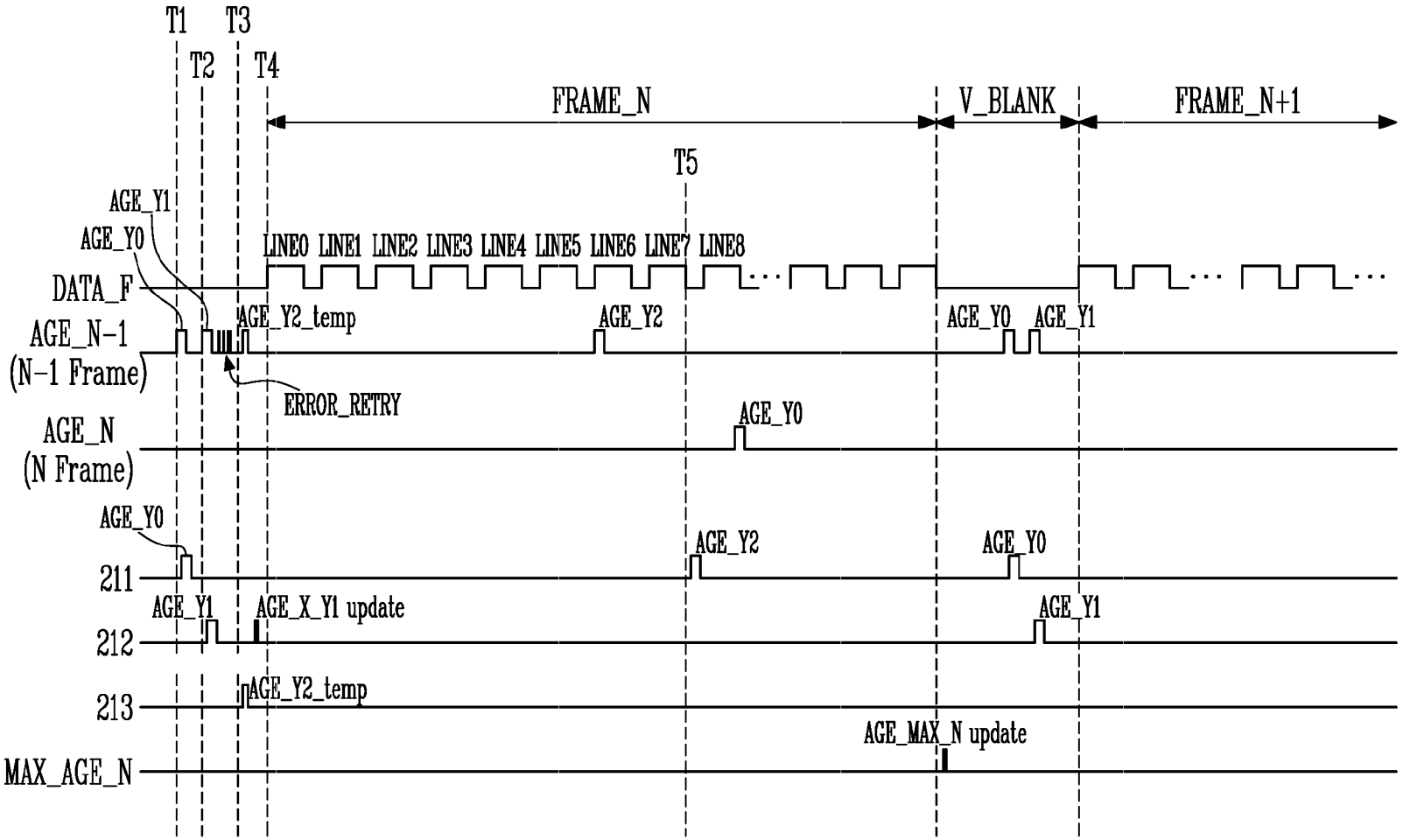
FIG. 5 is a waveform diagram illustrating an operation of the degradation compensator of FIG. 2.

FIG. 5 is a waveform diagram illustrating an operation of the degradation compensator of FIG. 2.

Referring to FIGS. 2, 3, and 5, a current input data DATA_F (or frame data) is the input image data DATA1 described with reference to FIG. 1, and may be, for example, input image data DATA1 of an Nth frame FRAME_N. The current input data DATA_F may include line input data from LINE0 to LINE8 corresponding to the scan lines from SL1 to SLn (or pixel rows) described with reference to FIG. 1.

First degradation values AGE_N−1 represent degradation values loaded from the first memory 150, and may be, for example, degradation vales included in stress data of an (N−1)th frame.

Second degradation values AGE_N represent degradation values stored (re-stored or updated) in the first memory 150, and may be, for example, degradation values included in stress data of the Nth frame FRAME_N.

At a first time T1, zeroth line data AGE_Y0 (i.e., degradation values corresponding to a zeroth line of previous stress data) may be loaded from the first memory 150. The first time T1 is a previous time of the Nth frame FRAMEN, and may be a time between the Nth frame FRAME_N and the (N−1)th frame (e.g., a time in a blank period V_BLANK). Subsequently, the zeroth line data AGE_Y0 may be stored (or recorded) in the first buffer 211.

The error detector 220 may determine whether each of degradation values included in the zeroth line data AGE_Y0 is normal. An operation of the error detector 220 (or the determiner 221 (see i.e., FIG. 3)) may be performed at the same time when the zeroth line data AGE_Y0 is stored.

At a second time T2, first line data AGE_Y1 (i.e., first line data AGE_Y1 of the previous stress data) may be loaded from the first memory 150. The second time T2 is a time just after the first time T1, and may be a time between the first time T1 and the Nth frame FRAME_N. The first line data AGE_Y1 may be stored (or recorded) in the second buffer 212.

The error detector 220 may determine whether each of degradation values included in the first line data AGE_Y1 is normal.

A case where a first degradation value AGE_X_Y1 in the first line data AGE_Y1 (e.g., an Xth degradation value in the first line data AGE_Y1) is abnormal will be assumed and described below.

The error detector 220 may determine when the first degradation value AGE_X_Y1 is greater than a maximum degradation value MAX_AGE_N. The first degradation value AGE_X_Y1 may be repeatedly re-loaded by a predetermined retry number from the first memory 150 (ERROR_RETRY), and the error detector 220 may sequentially repeatedly compare the re-loaded first degradation value AGE_X_Y1 with the maximum degradation value MAX_AGE_N. When the re-loaded first degradation value AGE_X_Y1 is greater than the maximum degradation value MAX_AGE_N, the error detector 220 may finally determine that the first degradation value AGE_X_Y1 is abnormal.

At a third time T3, adjacent degradation values AGE_Y2_temp adjacent to the first degradation value AGE_X_Y1 may be loaded from the first memory 150, and be stored in the third buffer 213.

The error detector 220 may update the first degradation value AGE_X_Y1 based on the adjacent degradation values AGE_Y2_temp and the maximum degradation value MAX_AGE_N.

During the Nth frame FRAME_N after a fourth time T4, the degradation compensator 141 may update the first degradation values AGE_N−1 (i.e., the previous stress data) based on the line input data from LINE0 to LINE8, and compensate for the line input data from LINE0 to LINE8 based on the second degradation values AGE_N. Meanwhile, during the Nth frame FRAME_N, data voltages corresponding to the compensated line input data from LINE0 to LINE8 may be provided from the data driver 130 (see FIG. 1) to the display 110 (see i.e., FIG. 1).

For example, in a period between the fourth time T4 and a fifth time T5, the degradation compensator 141 may update the zeroth line data AGE_Y0 stored in the first buffer 211 based on zeroth to seventh line input data LINE0 to LINE7. In addition, the updated zeroth line data AGE_Y0 may be stored as the second degradation values AGE_N, i.e., the zeroth line data AGE_Y0 of the stress data in the first memory 150. For example, after the fifth time T5 at which the seventh line input data LINE7 is provided, the zeroth line data AGE_Y0 among the second degradation values AGE_N may be stored in the first memory 150.

Meanwhile, before the fifth time T5 (e.g., at a time at which the sixth line input data LINE6 is provided), second line data AGE_Y2 among the first degradation values AGE_N−1 (or the previous stress data) may be loaded from the first memory 150. After the fifth time T5, the second line data AGE_Y2 may be stored in the first buffer 211. In addition, the error detector 220 may determine whether each of degradation values included in the second line data AGE_Y2 is normal.

When eighth line input data LINE8 is provided, the degradation compensator 141 may update the first line data AGE_Y1 stored in the second buffer 212 based on the eighth line input data LINE8.

That is, for every eight line input data, the degradation compensator 141 may sequentially load degradation values in a unit of a line, which are included in the previous stress data, i.e., line data, and alternately store the line data in the first buffer 211 and the second buffer 212. Also, the degradation compensator 14 may sequentially determine whether degradation values in the line data are normal, and update an abnormal degradation value based on adjacent degradation values.

In the blank period V_BLANK (i.e., in a period between the Nth frame FRAME_N and an (N+1)th frame FRAME_N+1), the degradation compensator 141 may update the maximum degradation value MAX_AGE_N of the second degradation values AGE_N (or the stress data). For example, the degradation compensator 141 may determine the largest degradation value among the second degradation values AGE_N as the maximum degradation value MAX_AGE_N of the stress data, and update the maximum degradation value MAX_AGE_N of the stress data.

As described with reference to FIG. 2, when a difference between the largest degradation value (i.e., a degradation value updated as the maximum degradation value MAX_AGE_N of the stress data) among the degradation values of the stress data (i.e., the second degradation values AGE_N) and a maximum degradation value of the previous stress data is greater than a reference value, the maximum degradation value MAX_AGE_N of the stress data is not updated, and may be equal to the maximum degradation value of the previous stress data (or the first degradation values AGE_N−1).

After the maximum degradation value MAX_AGE_N of the stress data is updated, the degradation compensator 141 may again perform an operation in a period between the first time T1 to the fourth time T4. In addition, an operation of the degradation compensator 141 in the (N+1)th frame FRAME_N+1 may be substantially identical to that of the degradation compensator 141 in the Nth frame FRAME_N. That is, the degradation compensator 141 may operate in one frame as a period.

Figure 6:
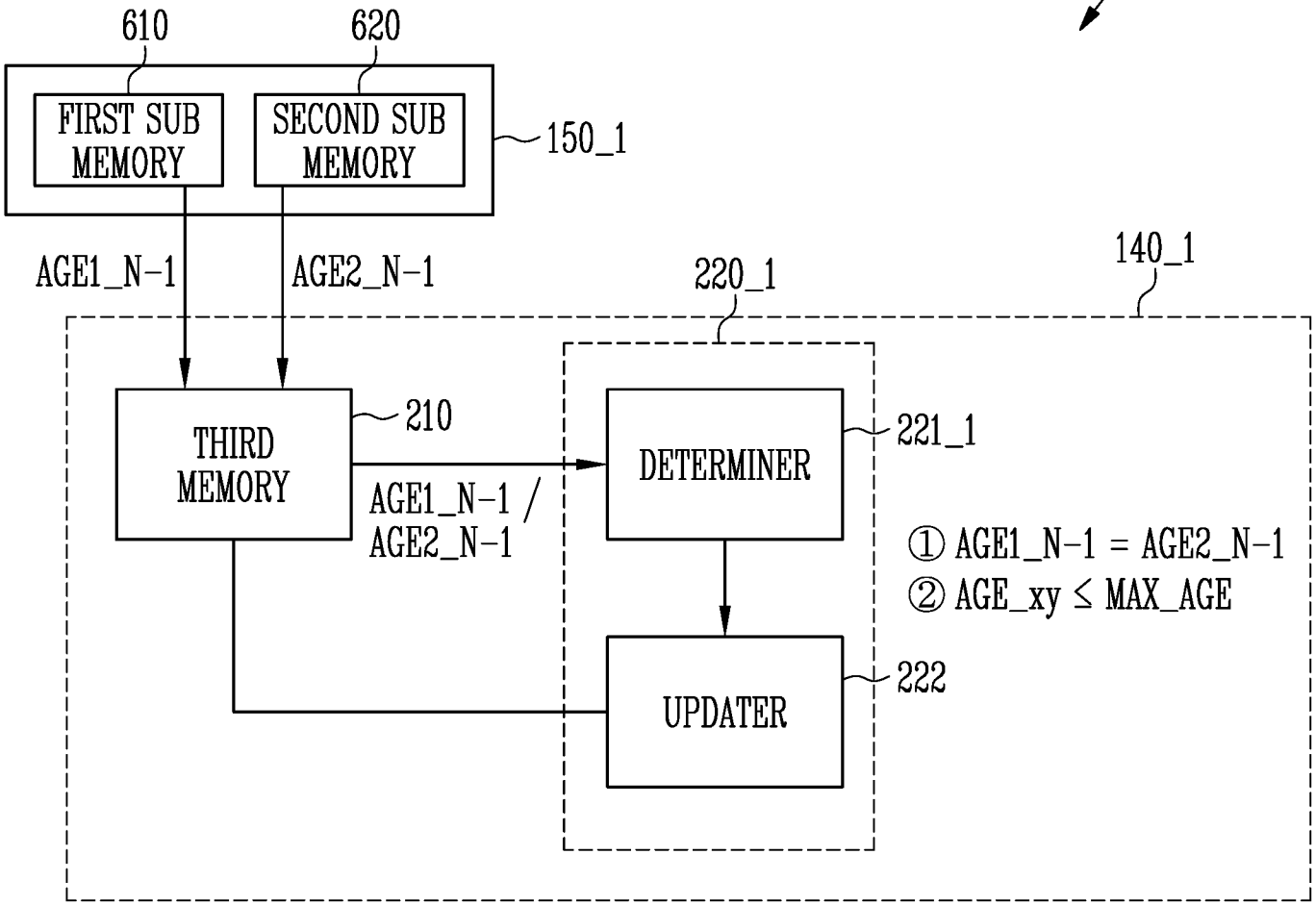
FIG. 6 is a block diagram illustrating an example of the display device of FIG. 1.

FIG. 6 is a block diagram illustrating an example of the display device of FIG. 1.

Referring to FIG. 6, a display device 100_1 is briefly illustrated based on a first memory 150_1 and a timing controller 140_1. The display device 100_1 may include other components (e.g., the data driver 130, the scaler 230, and the like) described with reference to FIGS. 1 and 2.

Referring to FIGS. 2 and 6, the first memory 150_1 may include a first sub-memory 610 (or first sub-memory device) and a second sub-memory 620 (or second sub-memory device).

Stress data DATA_A (see i.e., FIG. 1) loaded from the second memory 160 (see i.e., FIG. 1) may be simultaneously stored in the first sub-memory 610 and the second sub-memory 620. For example, the first sub-memory 610 may store the stress data DATA_A as first stress data (or first previous stress data), and the second sub-memory 620 may store the stress data DATA_A as second stress data (or second previous stress data).

The timing controller 140_1 (or degradation compensator) may include a third memory 210 and an error detector 220_1, and the error detector 220_1 may include a determiner 221_1 and an updater 222.

The third memory 210 may store first previous degradation values AGE1_N−1 which are provided from the first sub-memory 610 and are included in the first stress data and second previous degradation values AGE2_N−1 which are provided from the second sub-memory 620 and are included in the second stress data.

The determiner 221_1 may compare the first previous degradation values AGE1_N−1 of the first stress data and the second previous degradation values AGE2_N−1 of the second stress data with each other, and determine whether the first previous degradation values AGE1_N−1 of the first stress data and/or the second previous degradation values AGE2_N−1 of the second stress data is normal (i.e., whether the first previous degradation values AGE1_N−1 of the first stress data and/or the second previous degradation values AGE2_N−1 of the second stress data does not include any error). For example, the determiner 221_1 may compare a first degradation value among the first previous degradation values AGE1_N−1 of the first stress data and a second degradation value among the second previous degradation values AGE2_N−1 of the second stress data with each other, and determine whether the first degradation value and/or the second degradation value is normal. The second degradation value may correspond to the first degradation value. That is, the first degradation value and the second degradation value may correspond to one degradation value in the stress data DATA_A stored in the second memory 160.

For example, when the first previous degradation values AGE1_N−1 of the first stress data and the second previous degradation values AGE2_N−1 of the second stress data are equal to each other, the determiner 221_1 may determine that the first previous degradation values AGE1_N−1 of the first stress data and the second previous degradation values AGE2_N−1, i.e., loaded degradation values of the stress data are normal. That is, it may be determined that any error has not occurred in a data transmission process between the first memory 150_1 and the third memory 210. The determiner 221_1 may compare a degradation value AGE_xy included in the degradation values (i.e., the first previous degradation values AGE1_N−1 of the first stress data or the second previous degradation values AGE2_N−1) with a maximum degradation value MAX_AGE, and determine whether the degradation value AGE_xy is normal. When the degradation value AGE_xy is abnormal, the updater 222 may update the degradation value AGE_xy based on adjacent degradation values and the maximum degradation value MAX_AGE.

For example, when the first previous degradation values AGE1_N−1 of the first stress data and the second previous degradation values AGE2_N−1 are different from each other, the determiner 221_1 may determine that the first previous degradation values AGE1_N−1 of the first stress data and the second previous degradation values AGE2_N−1, i.e., the loaded degradation values of the stress data are abnormal. For example, when the first previous degradation values AGE1_N−1 of the first stress data and the second previous degradation values AGE2_N−1 are different from each other, the first previous degradation values AGE1_N−1 of the first stress data and the second previous degradation values AGE2_N−1 may be re-loaded from the first memory 150_1, and the determiner 221_1 may finally determine whether the re-loaded degradation values (i.e., the first previous degradation values AGE1_N−1 of the first stress data or the second previous degradation values AGE2_N−1) are normal based on the re-loaded first previous degradation values AGE1_N−1 of the first stress data and the re-loaded second previous degradation values AGE2_N−1.

For example, when the first degradation value among the first previous degradation values AGE1_N−1 of the first stress data and the second degradation value among the second previous degradation values AGE2_N−1 of the second stress data are different from each other, the updater 222 may update the degradation value AGE_xy (i.e., the first degradation value and/or the second degradation value) based on adjacent degradation values and the maximum degradation value MAX_AGE. That is, the determiner 221_1 may not perform an operation of comparing the degradation value AGE_xy with the maximum degradation value MAX_AGE, and the updater 222 may update the degradation value AGE_xy.

As described with reference to FIG. 6, the first memory 150_1 includes the first sub-memory 610 and the second sub-memory 620, and stores the stress data as the first and second stress data (i.e., the first memory 150_1 has a structure of two memory sets). The determiner 221_1 compares the degradation values in the first and second stress data (i.e., the first previous degradation values AGE1_N−1 and the second previous degradation values AGE2_N−1) with each other, determines whether an error has occurred in the data transmission process between the first memory 150_1 and the third memory 210, and update a degradation value having the error. Thus, an erroneous compensation operation of the display device, which is caused by an abnormal degradation value, can be prevented.

Figure 7:
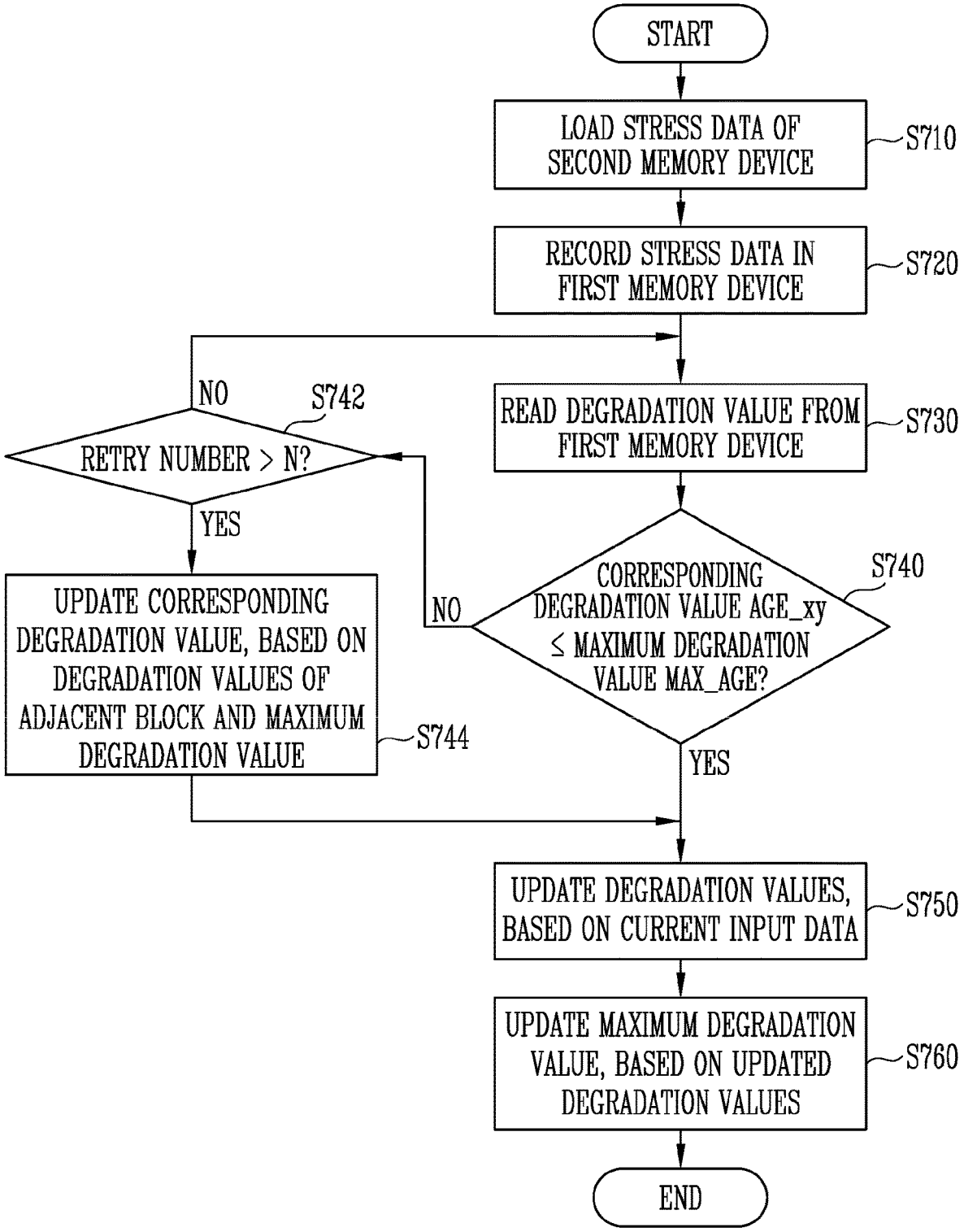
FIG. 7 is a flowchart illustrating a method of compensating for a degradation of the display device in accordance with embodiments of the present disclosure.

FIG. 7 is a flowchart illustrating a method of compensating for a degradation of the display device in accordance with embodiments of the present disclosure.

Referring to FIGS. 1, 2, and 7, the method of FIG. 7 may be performed in the display device 100 of FIG. 1 (or the degradation compensator 141 of in FIG. 2).

In the method of FIG. 7, when the display device 100 is powered on, the display device 100 may load stress data DATA_A of the second memory (S710), and stores (or records) the stress data DATA_A in the first memory 150 (S720).

As described with reference to FIG. 1, the first memory 150 may be implemented as a volatile memory device, and the second memory 160 may be implemented as a nonvolatile memory device.

Subsequently, in the method of FIG. 7, the display device 100 may read degradation values AGE (i.e., degradation values AGE included in the stress data DATA_A) from the first memory 150 (S730). The read degradation values AGE may be stored in the third memory 210.

In the method of FIG. 7, the display device 100 may compare the degradation values AGE with a maximum degradation value MAX_AGE, and determine whether each of the degradation values AGE is normal. For example, in the method of FIG. 7, the display device 100 may determine whether a degradation value AGE_xy is smaller than or equal to the maximum degradation value MAX_AGE (S740).

In the method of FIG. 7, when the degradation value AGE_xy is greater than the maximum degradation value MAX_AGE, the display device 100 may re-load the degradation value AGE_xy from the first memory 150, and again determine whether the re-loaded degradation value AGE_xy is smaller than or equal to the maximum degradation value MAX_AGE.

For example, in the method of FIG. 7, the display device 100 may determine whether a retry number is greater than a reference number (e.g., N) (S742), and repeatedly perform the step S730 of reading the degradation values AGE included in the stress data DATA_A and the step S740 of determining whether the degradation value AGE_xy is smaller than or equal to the maximum degradation value MAX_AGE, until the retry number is greater than the reference number.

In the method of FIG. 7, when the degradation value AGE_xy is greater than the maximum degradation value MAX_AGE, and the retry number is greater than the reference number, the display device 100 may finally determine that the degradation value AGE_xy is abnormal.

In the method of FIG. 7, the display device 100 may update the degradation value AGE_xy based on adjacent degradation values adjacent to the degradation value AGE_xy and the maximum degradation value MAX_AGE (S744). The adjacent degradation values may be degradation values corresponding to adjacent blocks adjacent to a block (i.e., one of the blocks BLK of the display 110) corresponding to the degradation value AGE_xy.

In an embodiment, in the method of FIG. 7, the display device 100 may update the degradation value AGE_xy by using Equation 1 described above.

In the method of FIG. 7, when the degradation value AGE_xy is smaller than or equal to the maximum degradation value MAX_AGE (i.e., when the degradation value AGE_xy is normal), or when the update of the degradation value AGE_xy is completed, the display device 100 may update the degradation values based on current input data (S750).

As described with reference to FIG. 2, in the method of FIG. 7, the display device 100 may update the degradation values through the scaler 230 and the age calculator 240.

In the method of FIG. 7, the display device 100 may update the maximum degradation value MAX_AGE based on the updated degradation values (S760). As described with reference to FIG. 5, in the blank period V_BLANK, the display device 100 may update the maximum degradation value MAX_AGE based on the largest degradation value among the updated degradation values.

Subsequently, in the method of FIG. 7, the display device 100 may generate compensated data by compensating for input image data DATA1 (or current input data) based on the updated stress data, and provide the display 110 with data voltages corresponding to the compensated data.

As described with reference to FIG. 7, in the method, the display device 100 determines whether each of the degradation values loaded from the first memory (i.e., the degradation values included in the stress data) is normal by comparing the degradation values with the maximum degradation value, and updates (or resets) an abnormal degradation value based on at least one degradation value. Thus, an erroneous compensation operation of the display device, which is caused by an abnormal degradation value, can be prevented.

Figure 8:
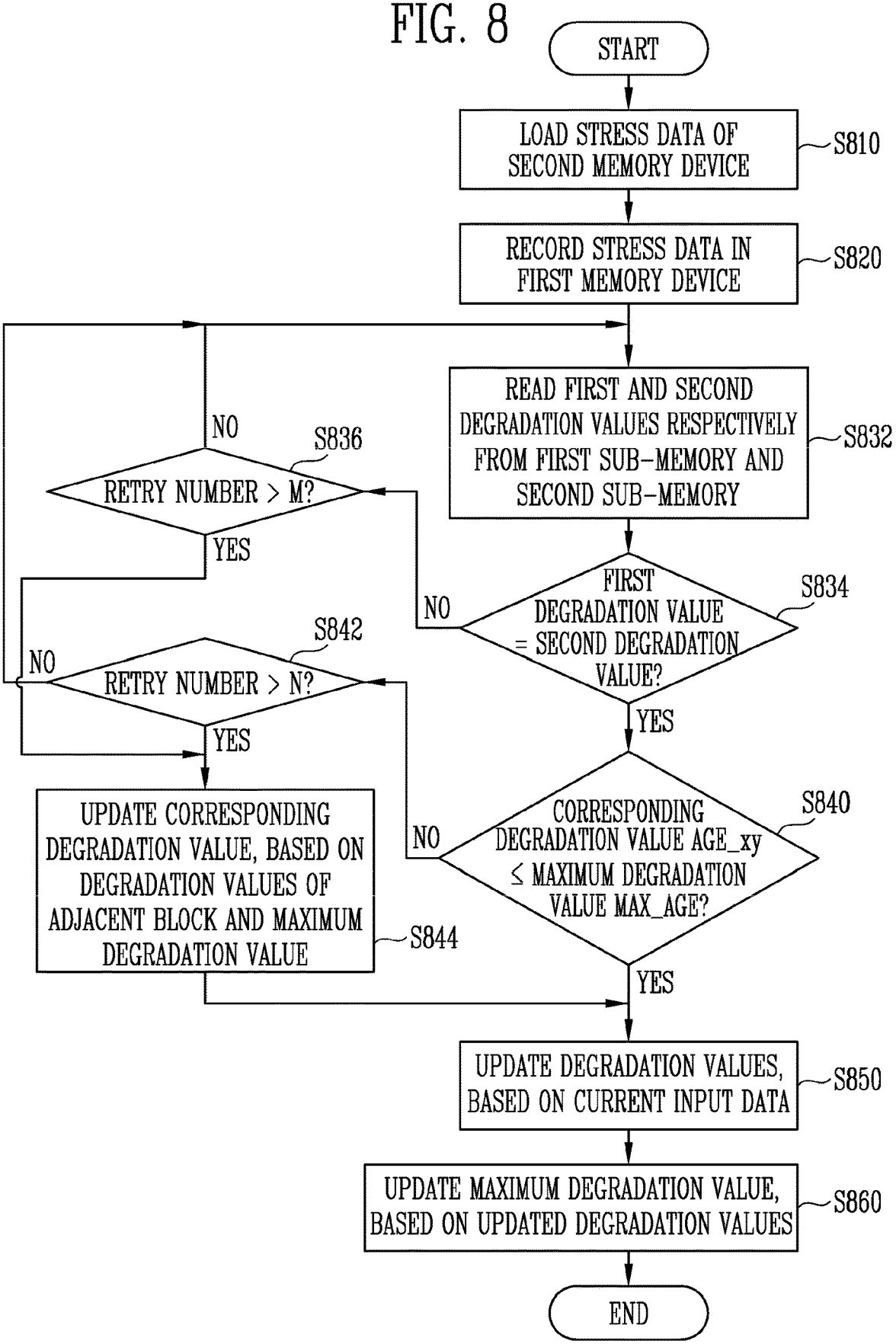
FIG. 8 is a flowchart illustrating an example of the method of FIG. 7.

FIG. 8 is a flowchart illustrating an example of the method of FIG. 7.

Referring to FIGS. 1, 6, 7, and 8, the method of FIG. 8 may be performed in the display device 100_1 of FIG. 6. The method of FIG. 8 is similar to that of FIG. 7, and therefore, overlapping descriptions will be omitted.

In the method of FIG. 8, when the display device 100_1 is power on, the display device 100_1 may load stress data DATA_A of the second memory 160 (S810), and stores (or records) the stress data DATA_A in the first memory 150 (S820).

As depicted in FIG. 6, in the method of FIG. 8, the display device 100_1 may store the stress data DATA_A as first stress data in the first sub-memory 610, and store the stress data DATA_A as second stress data in the second sub-memory 620.

Subsequently, in the method of FIG. 8, the display device 100_1 may read (or load) a first degradation value (i.e. a first degradation value included in the first stress data) from the first sub-memory 610 and read (or load) a second degradation value (i.e., a second degradation value which is included in the second stress data and corresponds to the first degradation value) from the second sub-memory 620 (S832).

In the method of FIG. 8, the display device 100_1 may compare the first degradation value and the second degradation value, and determine whether the first degradation value (and/or the second degradation value) is normal. For example, in the method of FIG. 8, the display device 100_1 may determine whether the first degradation value and the second degradation value are the same (S834), and determine that the first degradation value is normal, when the first degradation value and the second degradation value are the same. In the method of FIG. 8, the display device 100_1 may compare a degradation value AGE_xy (i.e., the first degradation value or the second degradation value) with a maximum degradation value MAX_AGE (S840), and determine whether the degradation value AGE_xy is normal. The step S840 of comparing the degradation value AGE_xy with the maximum degradation value MAX_AGE is substantially identical to the step S740 of comparing the degradation value AGE_xy with the maximum degradation value MAX_AGE, which is described with reference to FIG. 7, and therefore, overlapping descriptions will be omitted.

Meanwhile, when the first degradation value and the second degradation value are different from each other, the display device 100_1 may re-read the first degradation value and the second degradation value, and again determine whether the first degradation value and the second degradation value are the same. For example, in the method of FIG. 8, the display device 100_1 may determine whether a retry number (or first retry number) is greater than a first reference number (e.g., M, M is an integer greater than 0) (S836), and repeatedly perform the step S832 of reading the first degradation value and the second degradation value and the step S834 of comparing the first degradation value and the second degradation value, until the retry number is greater than the first reference number. For example, in the method of FIG. 8, when the first reference number is 0, the display device 100_1 may not repeat the step S832 of reading the first degradation value and the second degradation value and the step S834 of comparing the first degradation value and the second degradation value.

In the method of FIG. 8, when the retry number (i.e., the first retry number) is greater than the first reference number, the display device 100_1 may finally determine that the degradation value AGE_xy (i.e., the first degradation value or the second degradation value) is abnormal.

In the method of FIG. 8, the display device 100_1 may update the degradation value AGE_xy based on adjacent degradation values adjacent to the degradation value AGE_xy and the maximum degradation value MAX_AGE (S844).

In the method of FIG. 8, when the update of the degradation value AGE_xy is completed, or when the degradation value AGE_xy is smaller than or equal to the maximum degradation value MAX_AGE (i.e., when the degradation value AGE_xy is normal), the display device 100_1 may update the degradation values based on input image data DATA1 (or current input data) (S850), and update the maximum degradation value MAX_AGE based on the updated degradation values (S860). The step S840 of comparing the degradation value AGE_xy with the maximum degradation value MAX_AGE, the step S842 of determining whether the retry number is greater than a reference number (e.g., N), the step S850 of updating the degradation values and the step S860 of updating the maximum degradation value MAX_AGE may be substantially identical to the step S740 of comparing the degradation value AGE_xy with the maximum degradation value MAX_AGE, the step S742 of determining whether the retry number is greater than the reference number (e.g., N), the step S750 of updating the degradation values, and the step S760 of updating the maximum degradation value MAX_AGE.

As described with reference to FIG. 8, in the method, the display device 100_1 compares the first and second degradation values (or the first and second stress data) with each other, detect whether an error has occurred in a data transmission process through a memory interface (i.e., between the first memory 150_1 and the third memory 210), and updates a degradation value having the error. Thus, an erroneous compensation operation of the display device, which is caused by an abnormal degradation value, can be prevented.

Figure 9:
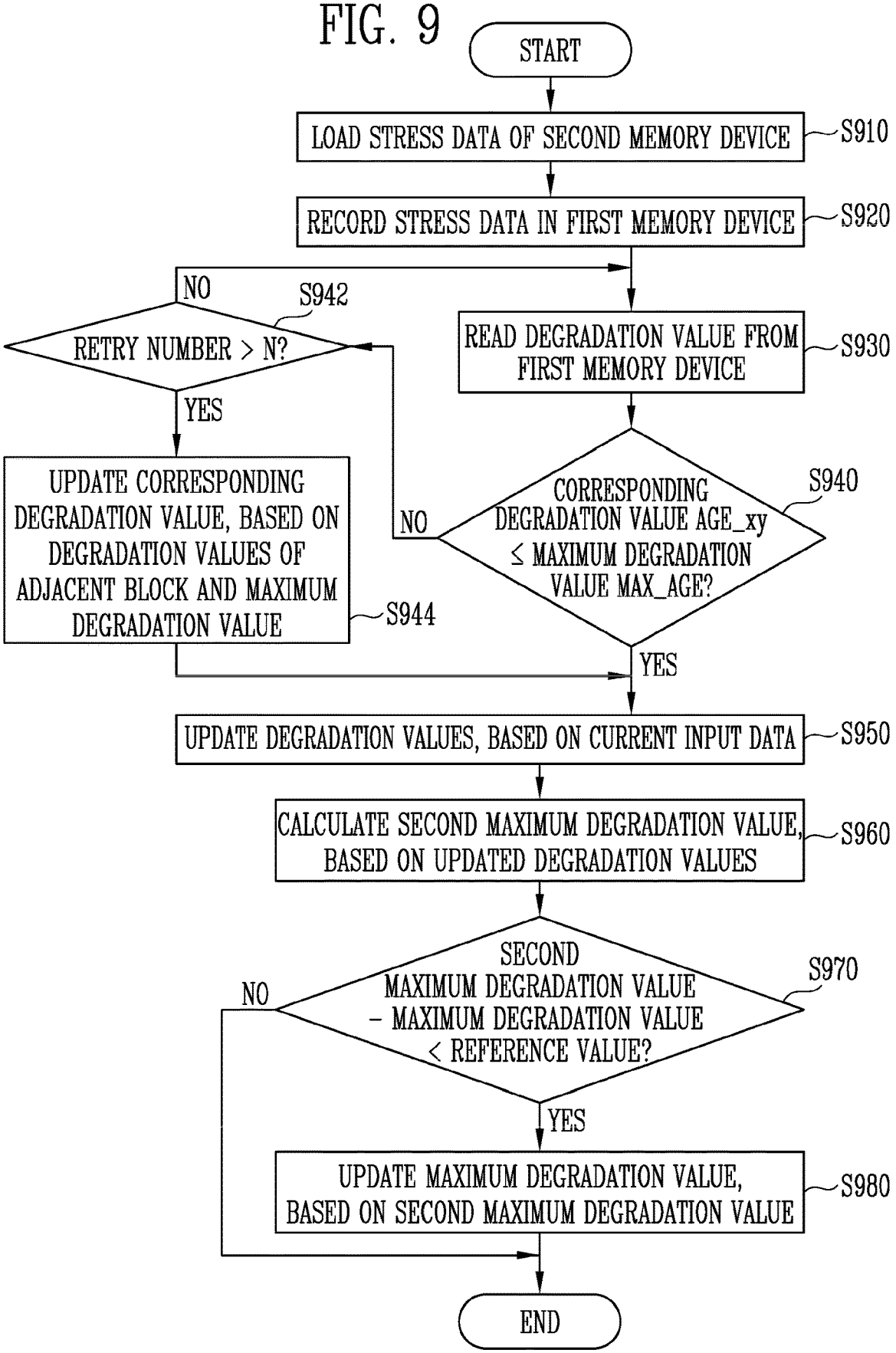
FIG. 9 is a flowchart illustrating another example of the method of FIG. 7.

FIG. 9 is a flowchart illustrating another example of the method of FIG. 7.

Referring to FIGS. 1, 7, and 9, the method of FIG. 9 may be performed in the display device 100 of FIG. 1 (or the display device 100_1 of FIG. 6).

Step S910 of loading stress data, step S920 of recording the stress data, step S930 of reading a degradation value, step S940 of comparing the degradation value with a maximum degradation value, step S942 of determining whether retry number is greater than a reference number, step S944 of updating the degradation value, and step S950 of updating degradation values are respectively substantially identical or similar to the step S710 of loading the stress data, the step S720 of recording the stress data, the step S730 of reading the degradation value, the step S740 of comparing the degradation value with the maximum degradation value, the step S742 of determining whether the retry number is greater than the reference number, the step S744 of updating the degradation value, and the step S750 of updating the degradation values, which are described with reference to FIG. 7, and therefore, overlapping descriptions will be omitted.

In the method shown in FIG. 9, the display device may calculate a second maximum degradation value based on the updated degradation values (S960). For example, in the method of FIG. 9, the display device may set the largest degradation value among the updated degradation values at a maximum degradation value.

Subsequently, in the method of FIG. 9, the display device may determine whether a difference between the second maximum degradation value and the maximum degradation value MAX_AGE (or first maximum degradation value) is smaller than a reference value (S970), and update the maximum degradation value MAX_AGE based on the second maximum degradation value, when the difference is smaller than the referent value (S980). As described above, the reference value may represent a degradation amount with which a specific block can be maximally degraded during an update period (i.e., during one frame).

In the method of FIG. 9, when the difference is greater than the reference value, the display device may determine that an error has occurred in the second maximum degradation value, and may not update the maximum degradation value MAX_AGE.

In the display device and the method of compensating for a degradation of the display device in accordance with the present disclosure, each of degradation values loaded from the first memory (i.e., degradation values which are included in stress data and represent a degradation degree or lifetime of each of pixels) is compared with a maximum degradation value, to determine whether each of the degradation values is normal, and an abnormal degradation value is updated (or reset) based on at least one adjacent degradation value. Thus, an erroneous compensation operation of the display device, which is caused by an abnormal degradation value, can be prevented.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims.

What is claimed is:

1. A display device comprising:

a display panel including a plurality of blocks, each including at least one pixel;

a first memory device configured to store a stress data including degradation values representing a degradation degree of each of the blocks;

a degradation compensator configured to load the stress data from the first memory device, configured to update the stress data based on current input data and a maximum degradation value, configured to update the maximum degradation value based on degradation values included in the updated stress data, and configured to generate compensated data by compensating for the current input data based on the updated stress data; and a data driver configured to generate data voltages based on the compensated data and configured to supply the data voltages to the display panel, wherein the degradation compensator determines whether a first degradation value included in the stress data is normal by comparing the first degradation value with the maximum degradation value, and updates the first degradation value based on at least one adjacent degradation value adjacent to the first degradation value, when the first degradation value is abnormal.

2. The display device of claim 1, wherein the degradation compensator includes:

a second memory circuit configured to store the stress data; and an error detection circuit configured to determine whether the first degradation value is normal, and configured to update the first degradation value.

3. The display device of claim 2, wherein the second memory circuit includes:

a first buffer configured to store one line data among the stress data;

a second buffer configured to repeatedly load and store the first degradation value from the first memory device, when the first degradation value is abnormal; and a third buffer configured to store the at least one adjacent degradation value.

4. The display device of claim 3, wherein the error detection circuit includes:

a determining circuit configured to determine that the first degradation value is abnormal, when the first degradation value is greater than the maximum degradation value; and an updating circuit configured to update the first degradation value-based on the at least one adjacent degradation value and the maximum degradation value, when the first degradation value is abnormal.

5. The display device of claim 4, wherein the updating circuit calculates an average value by averaging the at least one adjacent degradation value stored in the third buffer, and updates the first degradation value by weight-calculating the average value and the maximum degradation value.

6. The display device of claim 5, wherein a number of the at least one adjacent degradation value varies depending on position information of the first degradation value stored in the stress data.

7. The display device of claim 4, wherein, when the first degradation value is greater than the maximum degradation value, the determining circuit determines whether the first degradation value is abnormal by repeatedly comparing degradation values stored in the second buffer with the maximum degradation value.

8. The display device of claim 2, wherein the degradation compensator further includes:

a scaling circuit configured to generate scaled data by scaling grayscale values included in the current input data based on the maximum degradation value;

an age calculation circuit configured to update the stress data by accumulating the scaled data stored in the stress data; and a compensation circuit configured to generate the compensated data by compensating for the scaled data based on the updated stress data.

9. The display device of claim 1, wherein the degradation compensator sequentially determines whether the degradation values included in the stress data are normal during a frame period, and updates the maximum degradation value based on the largest value among the degradation values included in the updated stress data during a blank period, wherein the data voltages are applied to the display panel during the frame period, wherein the blank period does not overlap with the frame period.

10. The display device of claim 9, wherein the degradation compensator does not update the maximum degradation value, when the largest value among the degradation values included in the updated stress data is greater than a sum of the maximum degradation value and a reference value.

11. The display device of claim 1, wherein the first memory device includes:

a first sub-memory configured to store the stress data as first stress data; and a second sub-memory configured to the stress data as second stress data, wherein the degradation compensator loads the first and second stress data respectively from the first and second sub-memories, determines whether a first degradation value included in the first stress data and a second degradation value, which is included in the second stress data and corresponds to the first degradation value, are equal to each other, and determines that the first degradation value is normal, when the first and second degradation values are equal to each other.

12. The display device of claim 11, wherein, when the first and second degradation values are different from each other, the degradation compensator updates the first degradation value based on the at least one adjacent degradation value.

13. The display device of claim 1, further comprising a second memory device configured to store the stress data, wherein the first memory device is implemented as a volatile memory device, and the second memory device is implemented as a nonvolatile memory device, wherein, when power is applied, the first memory device subsequently loads the stress data from the second memory device.

14. A method of compensating for a degradation of a display device, the method comprising steps of:

recording a stress data in a first memory device;

reading a first degradation value included in the stress data from the first memory device;

determining whether the first degradation value is normal by comparing the first degradation value with a maximum degradation value;

updating the first degradation value based on at least one adjacent degradation value adjacent to the first degradation value, when the first degradation value is abnormal;

updating the stress data based on current input data and the maximum degradation value, when the first degradation value is normal; and generating compensated data by compensating for the current input data based on the updated stress data, wherein the stress data includes degradation values representing a degradation degree of each of a plurality of blocks of a display panel, and wherein each of the plurality of blocks includes at least one pixel.

15. The method of claim 14, further comprising steps of:

generating data voltages based on the compensated data; and supplying the data voltages to the display panel.

16. The method of claim 15, wherein the determining of whether the first degradation value is normal is accomplished by:

determining whether the first degradation value is smaller than or equal to the maximum degradation value; and re-reading the first degradation value, when the first degradation value is greater than the maximum degradation value.

17. The method of claim 16, wherein the re-reading the first degradation value is accomplished by:

repeating, N times (N is a positive integer), the reading the first degradation value and the determining of whether the first degradation is smaller than or equal to the maximum degradation value.

18. The method of claim 17, wherein the updating of the first degradation value is accomplished by:

calculating an average value by averaging the at least one adjacent degradation value; and updating the first degradation value by weight-calculating the average value and the maximum degradation value.

19. The method of claim 18, wherein the first memory device comprises a first sub-memory configured to store the stress data as first stress data and a second sub-memory configured to store the stress data as second stress data, wherein the determining of whether the first degradation value is normal further accomplished by:

determining whether a first degradation value included in the first stress data and a second degradation value which is included in the second stress data and corresponds to the first degradation value, are equal to each other; and comparing the first degradation value with the maximum degradation value, when the first and second degradation values are equal to each other.

20. The method of claim 14, further comprising steps of:

updating the maximum degradation value based on the largest value among the degradation values included in the updated stress data, wherein the maximum degradation value is not updated, when the largest value among the degradation values included in the updated stress data is greater than the sum of the maximum degradation value and a reference value.

21. A method of compensating for a degradation of a display device which includes a display panel including pixels, a memory device for storing stress data representing a degradation degree of the pixels, and a degradation compensator for compensating for image data for the pixels based on the stress data, the method comprising steps of:

transmitting a first degradation value included in the stress data from the memory device to the degradation compensator;

comparing, by the degradation compensator, the first degradation value with a predetermined maximum degradation value;

determining, by the degradation compensator, that the first degradation value is abnormal, when the first degradation value is greater than the maximum degradation value;

transmitting at least one adjacent degradation value adjacent to the first degradation value from the memory device to the degradation compensator, when the first degradation value is abnormal; and updating, by the degradation compensator, the first degradation value based on the at least one adjacent degradation value.

22. The method of claim 21, further comprising steps of:

generating, by degradation compensator, a second degradation value by updating the updated first degradation value based on a grayscale value included in the image data;

transmitting the second degradation value from the degradation compensator to the memory device; and updating, by the memory device, the stress data based on the second degradation value.

23. The method of claim 22, further comprising steps of:

updating, by the degradation compensator, the maximum degradation value based on the second degradation value; and transmitting the updated maximum degradation value from the degradation compensator to the memory device.

24. The method of claim 21, wherein the determining of that the first degradation value is abnormal accomplished by:

re-transmitting the first degradation value from the memory device to the degradation compensator;

comparing, by the degradation compensator, the re-transmitted first degradation value with the maximum degradation value; and determining, by the degradation compensator, that the first degradation value is abnormal, when the re-transmitted first degradation value is greater than the maximum degradation value.

25. The method of claim 21, wherein the updating of the first degradation value is accomplished by:

calculating, by the degradation compensator, an average degradation value by weight-averaging the at least one adjacent degradation value and the maximum degradation value; and updating, by the degradation compensator, the average degradation value as the first degradation value.

* * * * *